United States Patent [19]

Takeda

[11] Patent Number: 5,049,937

[45] Date of Patent: Sep. 17, 1991

[54] IMAGING DEVICE WHICH USES TRANSPARENT OR NON-TRANSPARENT DEVELOPER BASED ON MEDIUM USED

[75] Inventor: Katsuhiko Takeda, Osaka, Japan

[73] Assignee: Minolta Camera Kabushiki Kaisha, Osaka, Japan

[21] Appl. No.: 503,962

[22] Filed: Apr. 4, 1990

[30] Foreign Application Priority Data

Apr. 5, 1989 [JP] Japan ..... 1-84784
Apr. 5, 1989 [JP] Japan ..... 1-84785

[51] Int. Cl.[5] ..... G03G 15/06

[52] U.S. Cl. ..... 355/245; 355/311; 355/326

[58] Field of Search ..... 355/311, 325, 245, 326, 355/327, 308, 204, 309, 15; 430/110, 111; 118/653, 656

[56] References Cited

U.S. PATENT DOCUMENTS

| | | | |
|---|---|---|---|
| 3,998,747 | 12/1976 | Yamakami et al. | 252/62.1 R |
| 4,040,828 | 8/1977 | Evans | 430/15 |
| 4,549,803 | 10/1985 | Ohno et al. | 355/14 FU |
| 4,847,658 | 7/1989 | Takebe et al. | 355/245 |
| 4,890,138 | 12/1989 | Miyamoto et al. | 355/245 X |
| 4,949,124 | 8/1990 | Kusumoto et al. | 355/326 X |

FOREIGN PATENT DOCUMENTS

| | | | |
|---|---|---|---|
| 0083740 | 7/1978 | Japan | 355/311 |
| 0004155 | 1/1983 | Japan | 355/311 |
| 0158430 | 8/1985 | Japan | 355/311 |
| 0070270 | 3/1988 | Japan | 355/311 |
| 0179953 | 7/1989 | Japan | 355/245 |

*Primary Examiner*—R. L. Moses
*Assistant Examiner*—William J. Royer
*Attorney, Agent, or Firm*—Burns, Doane, Swecker & Mathis

[57] ABSTRACT

An electrophotographic imaging device includes a first developer for carrying transparent type toner and a second developer for carrying non-transparent type toner. A paper supplying cassette is provided for supplying a sheet of recording medium. A recording medium detector is provided for detecting the type of recording medium loaded in the paper supplying cassette whether it is a transparent recording medium or a non-transparent recording medium. A controller is provided for controlling the selection between the first and second developers such that the first developer is selected when the recording medium detector detects that a transparent recording medium is loaded in the paper supplying cassette.

10 Claims, 7 Drawing Sheets

IMAGING DEVICE WHICH USES TRANSPARENT OR NON-TRANSPARENT DEVELOPER BASED ON MEDIUM USED

BACKGROUND OF THE INVENTION

1. Field of the Invention

The present invention relates to an imaging device which develops an image using the toner most suitable for the properties of the recording medium.

2. Description of the Prior Art

Electrophotographic copying machines and laser printers which form color images using color toners in addition to a black toner are known widely. Electrophotographic copying machines and printers are also widely used to produce images on a transparent film medium in order to produce a projection slide for use on overhead projectors (hereinafter OHP).

If conventional color toners are used to make a color copy for an OHP slide, the low transmissivity of conventional color toners causes the image projected by the light from the OHP to become black, although the image observed by reflected light is in color. It is therefore necessary to use transparent toners to prepare color slides for color overhead projections.

However, when images are formed on plain paper, it is desirable to use non-transparent toners, considering the cost of toner.

SUMMARY OF THE INVENTION

The object of the present invention is therefore to provide an imaging device which solves these problems.

The present invention has been developed with a view to substantially solving the above described disadvantages and has for its essential object to provide an improved electrophotographic imaging device.

In order to achieve the aforementioned objective, an electrophotographic imaging device according to the present invention comprises a first developer for carrying transparent type toner, a second developer for carrying non-transparent type toner, a supplying cassette for supplying a sheet of recording medium, a recording medium detector for detecting the type of recording medium loaded in the supplying cassette between transparent recording medium and non-transparent recording medium, and a controller for controlling the selection between the first and second developers such that the first developer is selected when the recording medium detector detects that transparent recording medium is loaded in the supplying cassette.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
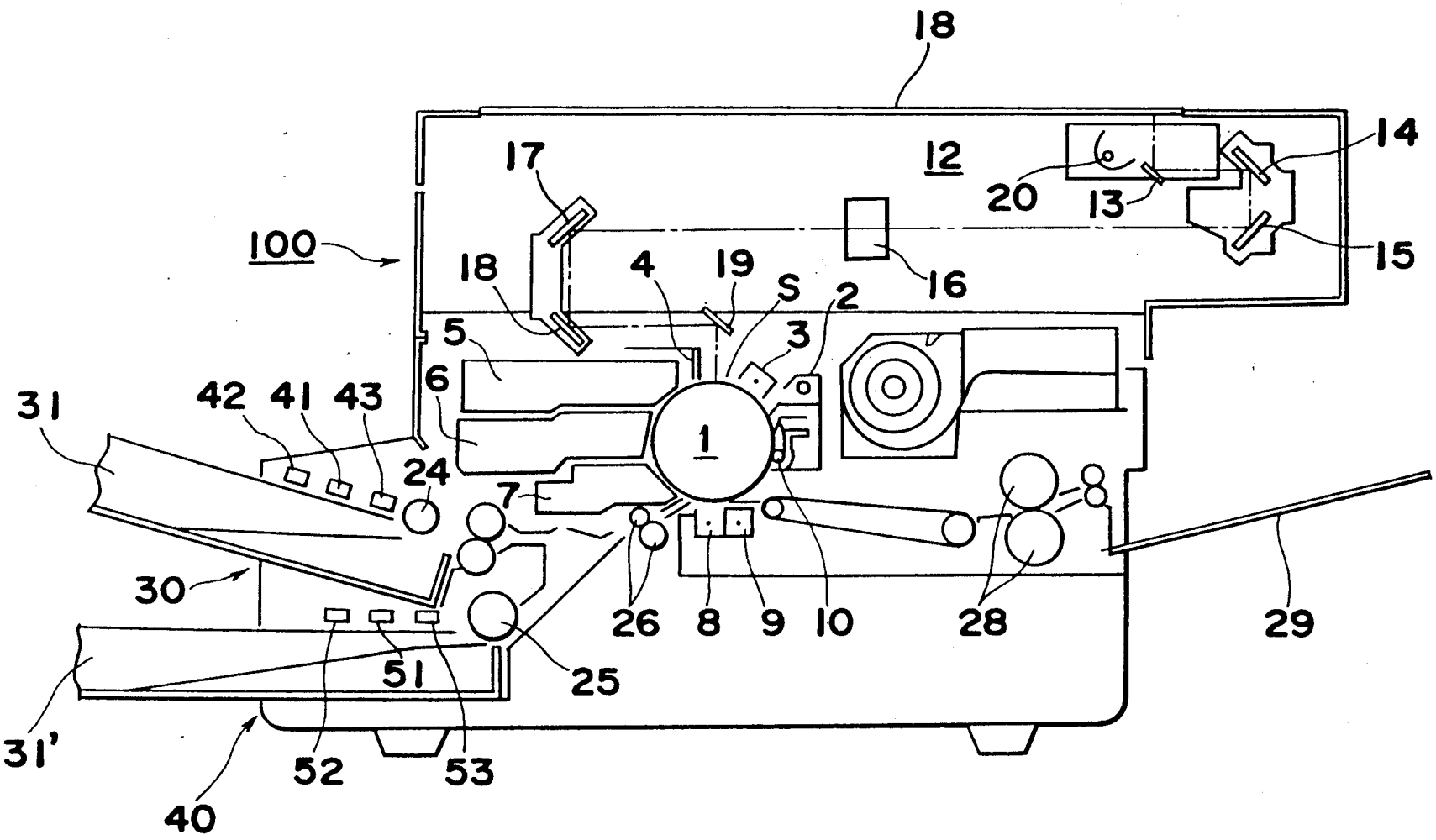
FIG. 1 is a cross-sectional view showing the major components of a copier according to the present invention.

Referring to FIG. 1, a cross section of the primary components of a photocopier according to the present invention is shown.

In this figure, a photoconductive drum 1 is supported at approximately the center of a copier 100 so that it can rotate counterclockwise. Positioned sequentially around the photoconductive drum 1 are the eraser brush 2, main charger 3, image end and inter-image eraser 4, three developers 5, 6 and 7, transfer charger 8, separation charger 9, and cleaning unit 10. The photoconductive drum 1 is provided with a photoconductive layer on the surface. The photoconductive layer is uniformly charged by passing the eraser brush 2 and the main charger 3, and a static latent image is formed on the surface by exposing the drum to the image from the optical scanning unit 12 through slit S. The image end and inter-image eraser 4 removes any unnecessary charge on the photoconductive layer when the latent image is formed.

The optical scanning unit 12 is located below an original glass 18 so that it can scan the original, and is comprised of light source 20, movable mirrors 13, 14 and 15, lens 16, and fixed mirrors 17, 18 and 19. The light source 20 and movable mirror 13 are driven together to move as a unit to the left as seen in FIG. 1 at the rate v/m where v is the circumferential speed of the photoconductive drum 1 and m is the copy magnification ratio, and movable mirrors 14 and 15 are driven to move to the left as a unit at the rate v/2 m. The copy magnification ratio mechanism and scanning unit drive mechanism may be of any known type and, therefore, the detailed description thereof is omitted.

Of the three developers 5, 6 and 7, first developer 5 is loaded with a transparent color toner, and second developer 6 is loaded with a non-transparent color toner. The third developer 7 is loaded with black toner. Each of the first, second and third developers 5, 6 and 7 is provided with a mechanical key, magnetic code, or similar means for identifying the type of toner, specifically for identifying the color of toner and for identifying whether the toner is transparent type or not. The copier 100 is also provided with toner identification (ID) sensors 5*a*, 6*a* and 7*a* (not shown in FIG. 1, but shown in FIG. 5) which cooperate with the key or read the magnetic code of the respective developers 5, 6 and 7 when these are loaded in the copier 100, and the ID signal from the sensors is input to the control circuit, which is described in detail below. The ID key and corresponding detection switch, and the magnetic code detector may be made of any known type and, therefore, the detailed description is omitted.

The paper feed device is provided on the left side of the copier, and in the present embodiment is provided with two paper feed cassette openings 30 and 40 one above the other. When the cassettes 31 and 31' are installed in the paper feed cassette openings 30 and 40, the paper is carried from the cassettes by paper feed rollers 24 and 25, which pressure contact the top of the recording medium, i.e., copy paper or transparent sheet, to the timing roller 26 according to the paper feed signal output from the control device, which will be described later. The timing roller 26 is driven according to the paper feed timing signal output from the control device, and carries the recording medium to the image transfer position. At this point the toner image formed on the photoconductive drum 1 is transferred to the recording medium, and the recording medium is then carried through the fusing unit 28 and ejected into the exit tray 29.

The paper feed cassette opening 30 is provided with a transmissivity sensor 41, a color sensor 42, and an empty sensor 43. The transmissivity sensor 41 determines whether the recording medium stored in the cassette 31 is a high transmissivity OHP film or plain paper; the color sensor 42 determines whether the plain paper is white paper or color paper; and the empty sensor 43 detects whether there is any recording medium left in the cassette 31. The other paper feed cassette opening 40 is likewise provided with an identical transmissivity sensor 51, color sensor 52, and empty sensor 53. As each of these sensors and the construction of the paper feed cassette opening 40 are identical to those of the paper feed cassette opening 30, the description below concerns specifically the first paper feed cassette opening 30.

Figure 2:
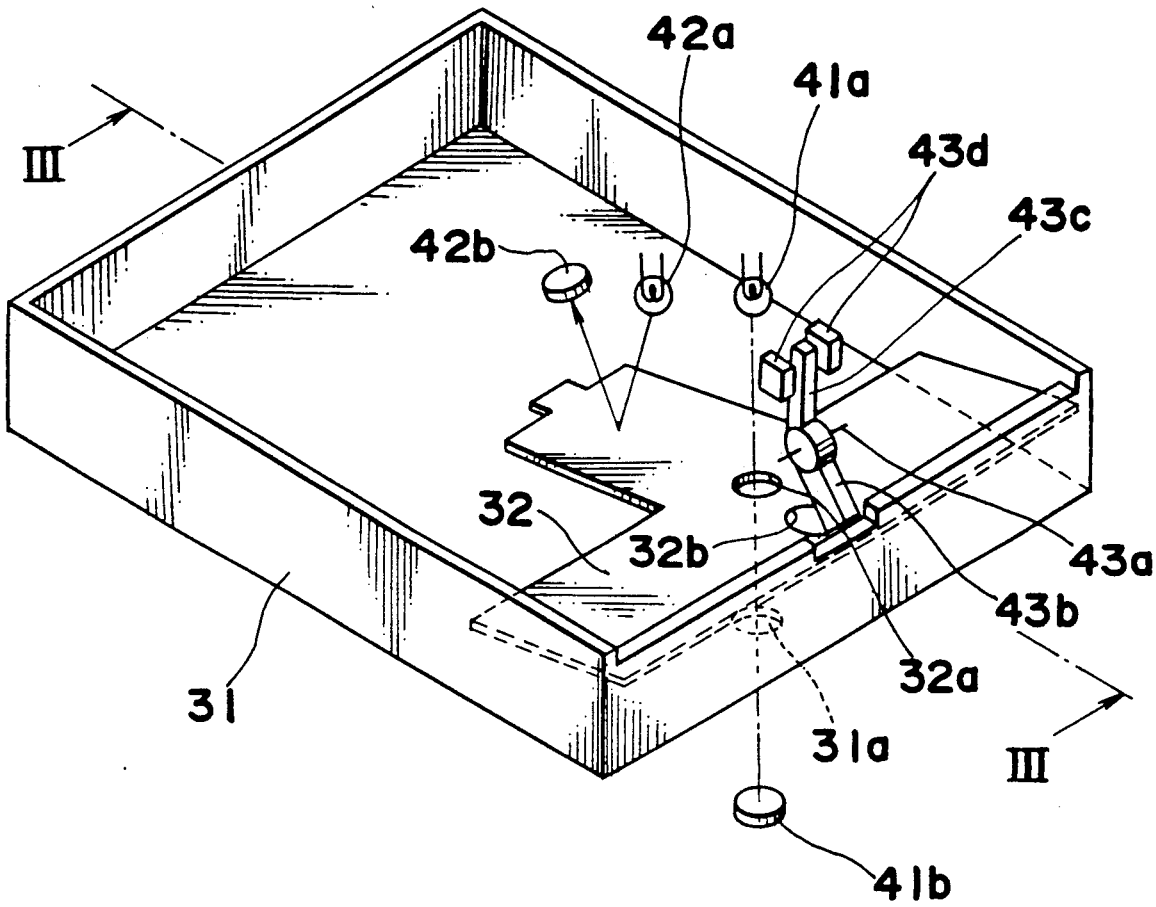
FIG. 2 is a perspective view of a cassette accommodated in the copier of FIG. 1.
Figure 3:
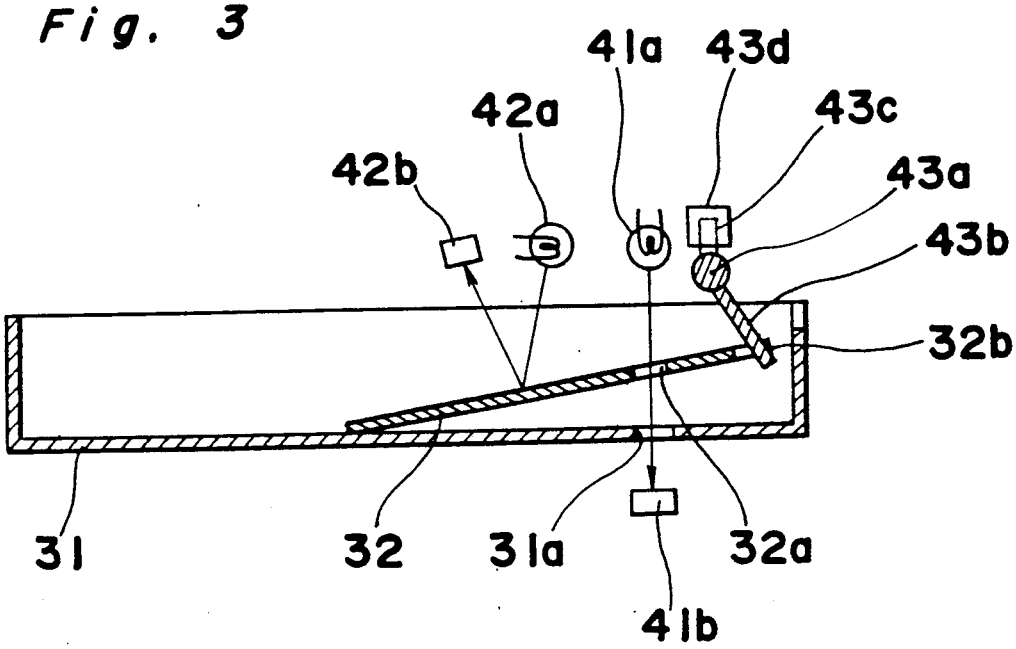
FIG. 3 is a cross-sectional view of the cassette shown in FIG. 2.

Referring to FIGS. 2 and 3, cassette 31 and the positions of the sensors relative to the cassette 31 are shown. Particularly, FIG. 2 shows a perspective view of the cassette 31 and FIG. 3 shows a cross-sectional view taken alone line III—III shown in FIG. 2.

The transmissivity sensor 41 which detects the transparency of the sheet stored in the cassette 31 is comprised of a light source lamp **41*a* and a light receptor 41*b*, which may be a CdS. The light source lamp 41*a* is positioned above the cassette 31, and the light receptor 41*b* is below the cassette 31. Openings 32*a* and 31*a* are provided in lifter plate 32 inside the cassette 31 and in the bottom of the cassette 31 as light passages between the light source lamp 41*a* and light receptor 41*b*. When the cassette 31 is loaded with OHP film, the light from the light source lamp 41*a* passes through the OHP film and is detected by the light receptor 41*b*, but when the cassette 31 is loaded with plain paper, the transmissivity of the recording medium is significantly lower than that of the OHP film and the light emission cannot be detected by the light receptor 41*b***. This difference makes it possible to determine whether the recording medium is a transparent sheet, i.e., OHP film, or plain paper.

The color sensor 42, which determines whether the plain paper loaded in the cassette 31 is white or color paper, is comprised of a light source lamp **42*a* and a light receptor 42*b*, which are provided at a specific interval above the cassette 31 so that the light projected from the light source lamp 42*a* reflects off the copy paper and enters the light receptor 42*b*. The light receptor 42*b* may be of any known color sensor having three detector elements sensitive to the tristimulus values X, Y and Z for the red, green, and blue spectra, respectively, as used in colorimeters and color difference meters. The color of the copy paper can be determined from the conditions of the output from these three detectors (HIGH or LOW signals). One example of the possible correlations between the output . of the detectors and the color of the paper is shown in Table 1. The flags F1 and F2 shown in Table 1 will be used in the operation of the control circuit, which will be described later in connection with the flow chart of FIG. 6**.

TABLE 1

| Copy paper color | White | Yellow | Magenta | Red | Cyan | Green | Blue | Black |
|---|---|---|---|---|---|---|---|---|
| Red detector | H | H | H | H | L | L | L | L |
| Green detector | H | H | L | L | H | H | L | L |
| Blue detector | H | L | H | L | H | L | H | L |
| Flag F1 | 1 | 1 | 1 | 1 | 1 | 1 | 1 | 0 |
| Flag F2 | 0 | 1 | 1 | 1 | 1 | 1 | 1 | 1 |

It is necessary to detect whether there is any recording medium in the cassette 31 because it is gradually consumed during the course of copier operation and may run out. The empty sensor 43 provided for this purpose is comprised of a detection member, which has a contact **43*b* that turns around the shaft 43*a* and an interrupter 43*c* on the other side of the shaft 43*a*, and a photoelectric detector 43*d***, which is comprised of a light-emitting element and a light receptor.

When the cassette 31 is loaded with OHP film, plain copy paper, or any other type of recording medium, the contact **43*b* touches the top of the stack and turns counterclockwise, when viewed in FIG. 3, causing the interrupter 43*c* on the opposite side to move outside the . light path of the photoelectric detector 43*d*. When the recording medium in the cassette 31 is depleted, the contact 43*b* drops into the notch 32*b* in the lifter plate 32 so that it extends below the lifter plate 32, as shown in FIG. 3. Thus, the interrupter 43*c* blocks the light path of the photoelectric detector 43*d***, making it possible to detect that no recording medium is left in the cassette.

Each of the paper feed cassette openings 30 and 40 is also provided with a detector to determine the size of the recording medium loaded in the cassette. This detector can be any known type, and therefore, the detailed description of the same is omitted.

Figure 4:
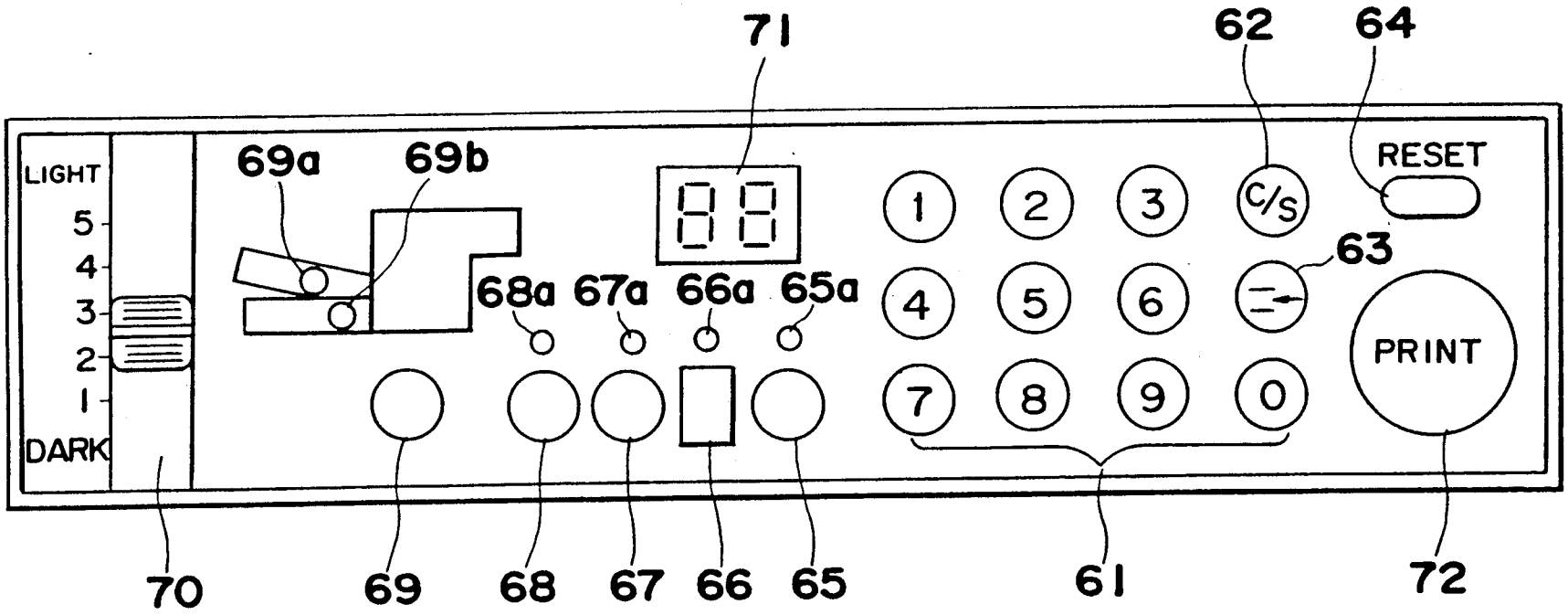
FIG. 4 is a front elevational view of an operation panel provided on the copier of FIG. 1.

Referring to FIG. 4, one example of an operation panel for a copier according to the present invention is shown. As shown in this figure, the operation panel has a keypad 61 for entering the number of copies to be made, a clear/stop button 62, an interrupt button 63, a reset button 64, and a black-and-white or color copy selection key 65.

The operation panel further has an automatic toner selection mode button 66 which is used to select manual toner selection mode or automatic toner selection mode. When the automatic toner selection mode is selected by button 66, the transparent or non-transparent toner is automatically selected according to whether or not the recording medium is OHP film or plain copy paper. Furthermore, a transparent toner selection button 67 is provided which is used to select the transparent toner when the toner selection mode is set to manual by button 66, and a non-transparent toner selection button 68 which is used to select the non-transparent toner when the toner selection mode is set to manual by button 66. Also provided is a copy paper selector 69 which selects either paper feed cassette opening 30 or 40. Furthermore, as in other known copier, copy density control 70, copy counter 71, and print key 72 are provided.

The print key 72, which is used for start the copy process, is provided integrally with an LED 72*a*. The LED 72*a* is used to notify the operator of copier irregularities, such as when the copy paper loaded in the cassette runs out, by lighting the print key 72 red or a similar warning color.

The other LEDs 65*a*, 66*a*, 67*a* and 68*a* light when the corresponding control, i.e., color copy selection key 65, automatic toner selection mode button 66, transparent toner selection button 67 non-transparent toner selection button 68, respectively, has been operated. The two other LEDs 69*a* and 69*b* light according to which cassette has been selected by the copy paper selector 69.

Figure 5:
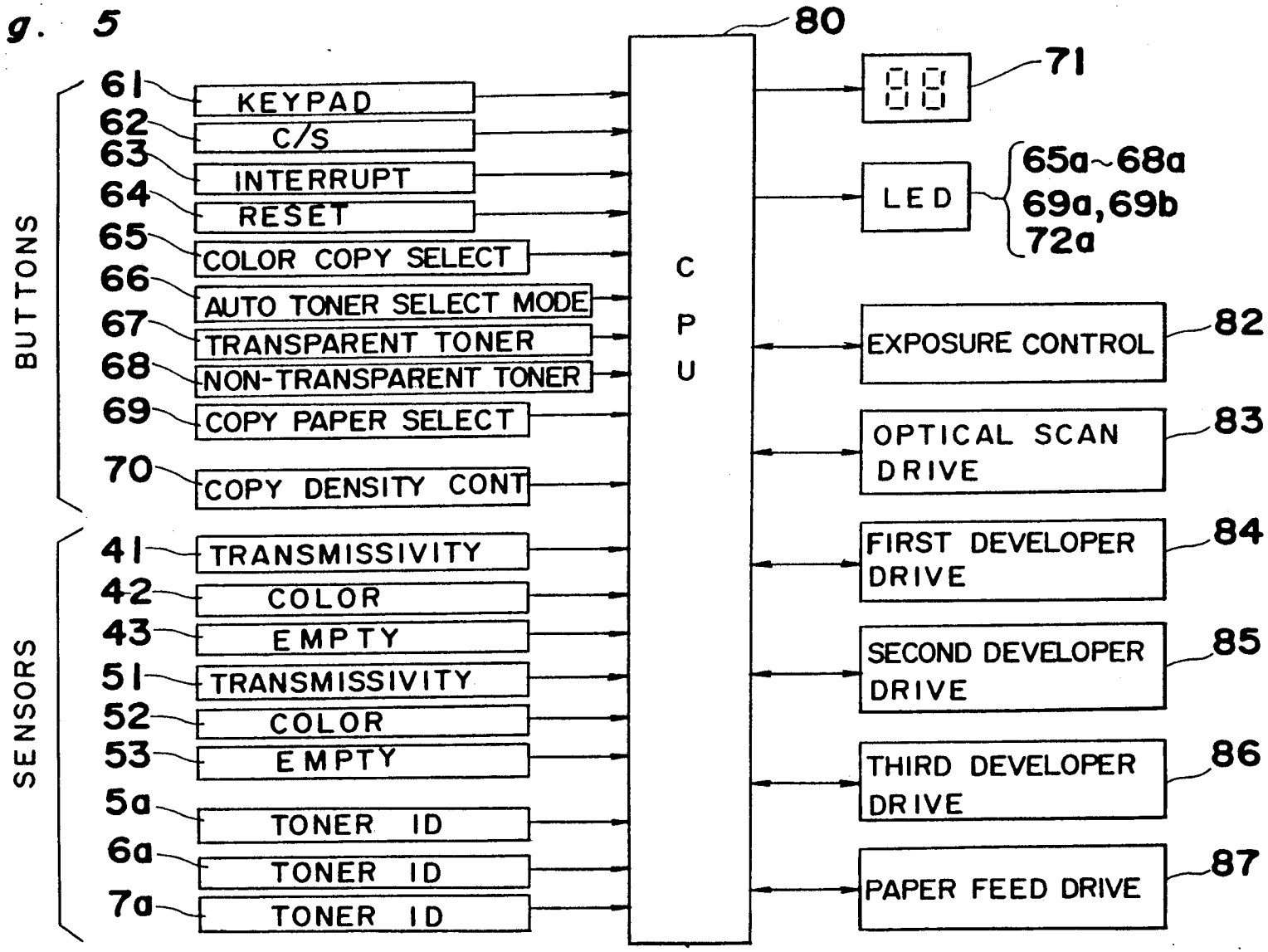
FIG. 5 is a block diagram of a control circuit employed in the copier of FIG. 1.

Referring to FIG. 5, a block diagram of the control circuit in a copier according to the present invention is shown. Input to CPU 80 are selection signals from the various controls on the operation panel shown in FIG. 4, specifically from keypad 61, clear/stop button 62, interrupt button 63, reset button 64, color copy selection key 65, automatic toner selection mode button 66, transparent toner selection button 67, non-transparent toner selection button 68, copy paper selector 69, copy density control 70, and other possible controls.

Also input to CPU 80 are the detection signals from the transmissivity sensors 41 and 51, color sensors 42 and 52, and empty sensors 43 and 53 provided in the two paper feed cassette openings 30 and 40, and from the toner identification sensors 5*a*, 6*a* and 7*a*, which detect what type of toner (transparent, non-transparent, and color) is loaded in each developer 5, 6 and 7 when the developers 5, 6 and 7 are loaded in the copier.

The copy counter 71, the LEDs 65*a*, 66*a*, 67*a*, 68*a*, 69*a* and 69*b* which light when the corresponding selector 65, 66, 67, 68, and 69 is operated, and the LED 72*a* which lights when the cassettes 31 and 31, become empty are connected to the CPU 80, which outputs the control signals causing them to light.

Further connected to CPU 80 are: exposure control assembly 82, optical scanning drive assembly 83, first driver 84 for driving the first developer 5, second driver 85 for driving the second developer 6, third driver 86 for driving the third developer 7 and the paper feed drive assembly 87, which feeds the recording medium from the paper feed cassette to the transfer position and fusing position, and then ejects the copy to the exit tray. Other assemblies which are required for operation and control of the copier are, of course, also controlled by the CPU 80.

Figure 6:
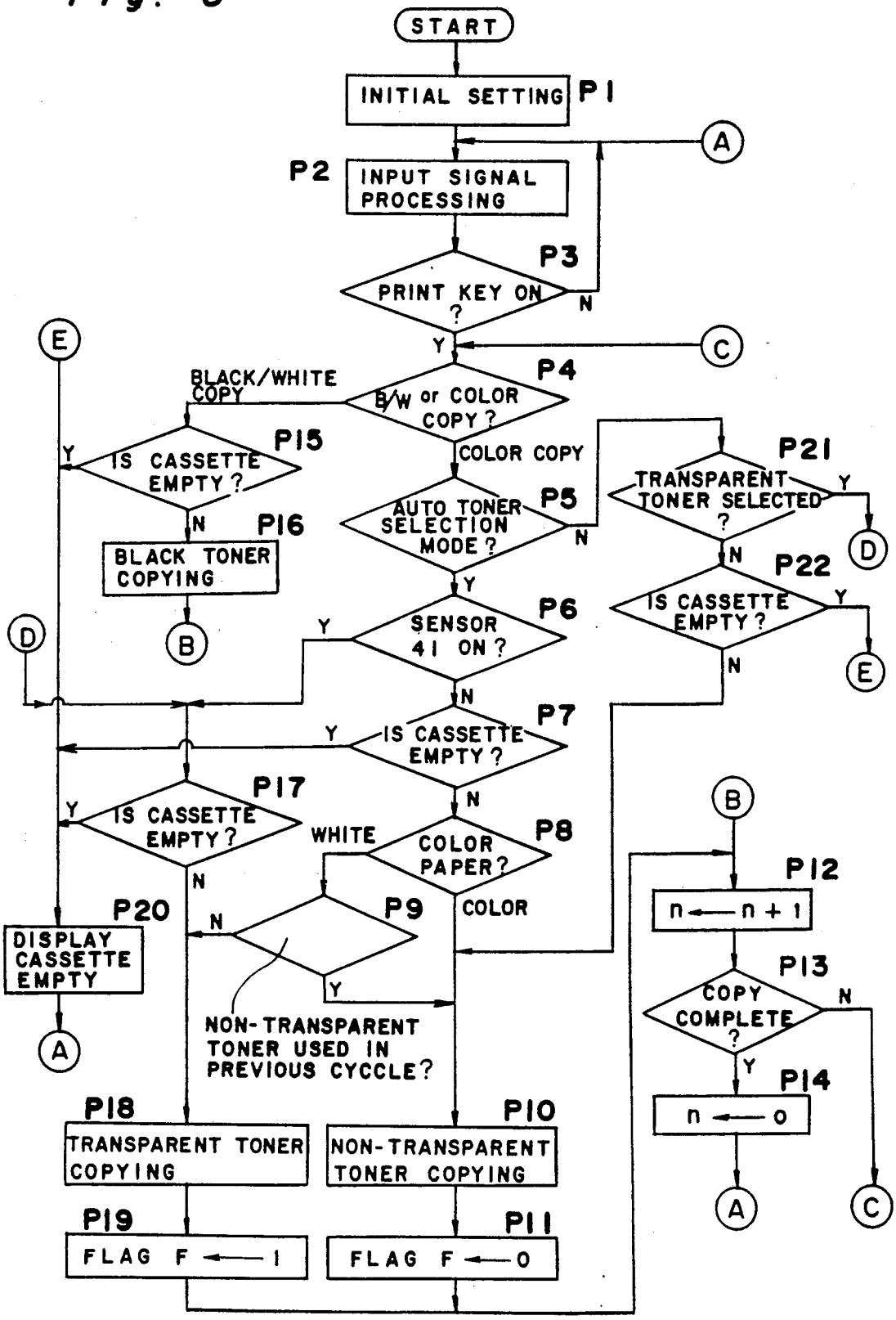
FIG. 6 is a flow chart showing an operation of the control circuit of FIG. 5.

Referring to FIG. 6, a flow chart is shown for the operation of the control circuit, which controls the copy process with either transparent or non-transparent toner according to the selected recording medium.

When the power is turned on, the memory is cleared and the copier settings are initialized to the default settings (step Pl). All signals, such as input signals from the operation panel, the input signals from the sensors 41, 42, 43, 51, 52 and 53 provided at the paper feed cassette openings 30 and 40, and other input signals are processed (step P2). Then, the copier waits for the print key 72 to be pressed to become ON (step P3).

When the print key 72 is depressed, it is detected whether the color copy selection key 65 has been set for a black-and-white copy or a color copy (step P4). If a color copy is selected the procedure advances to step P5, where it is then detected whether the automatic toner selection mode has been selected with the automatic toner selection mode button 66. If the automatic toner selection mode is set, it is then detected at step P6 whether the transmissivity sensor 41 is ON or not. If the transmissivity sensor 41 is OFF, the procedure advances to step P7, where it is detected whether the cassette is empty. If recording medium is loaded in the paper feed cassette, it is detected whether or not the recording medium is color paper (step P8). This is accomplished by the detection of flags F1 and F2 shown in Table 1. If the cassette is loaded with color paper (non-white paper), the developer 6 loaded with non-transparent toner is driven and the copying operation is carried out (step P10) and, thereafter, a flag F3 for indicating the toner type is set to 0 so it is indicated that the previous copy was made with the non-transparent toner (step P11). Then, the counter displaying how many copies have been made is incremented by 1 (step P12), and it is detected whether all of the set number of copies have been made (step P13). If all copies have been made, the copy counter is reset to 0 (step P14), and the procedure returns to step P2. If at step P13 it is detected that all copies have not been made, step P4 is returned to and the copying procedure continues.

If at step P4 it is detected that a black and white copy is selected, the procedure branches to step P15, where it is detected whether the cassette is empty or not. If recording medium is loaded in the paper feed cassette, the developer 7 loaded with the black toner is driven and the copy is made (step P16), and the procedure branches to the copy number processing procedure from step P12 as described above.

If it is detected at step P6 that the transmissivity sensor 41 is ON (meaning that the OHP films or the like are loaded in the cassette), the procedure branches to step P17, where it is determined whether the cassette is empty. If the cassette is not empty and some number of sheets of recording medium (OHP films) are loaded in the paper feed cassette, the developer 5 loaded with the transparent toner is driven and the copy is made (step P18). The flag F3, which in the description above was set to 0 to indicate that the previous copy was made with non-transparent toner, is now set to 1 to indicate that transparent toner is used for the copy procedure (step P19), and thereafter, the procedure branches to the copy number processing procedure from step P12 as described above.

If at step P8 it is detected that the recording medium is white paper, flag F3 is read to detect whether the previous copy was made with non-transparent toner or with transparent toner. If the result is transparent toner, the procedure branches to step P18, and if non-transparent toner, the procedure advances to step P10. This step is used to reduce the processing and copying time by skipping developer switching because a good copy can be produced on white paper with either transparent or non-transparent toner, and the developer used for the previous copy is therefore used again. Transparent toners are not used with color papers because the color of the transparent tone will be mixed with the color of the paper, and the results may not be acceptable.

If it is detected at step P5 that the automatic toner selection mode is not set, the procedure branches to step P21 and it is detected whether the transparent or non-transparent toner has been selected by the transparent toner selection button 67 or non-transparent toner selection button 68 on the operation panel. If the transparent toner was selected, the procedure moves to step P17. If the transparent toner was not selected, i.e., if the non-transparent toner was selected, it is detected at step P22 whether the cassette is empty or not, and if it is not empty, the procedure moves to step P10.

If at steps P7, P15, P17, and P22 it is detected that the paper feed cassette is empty, the procedure advances to step P20, at which LED 72*a* is turned on to notify the user that the selected paper feed cassette is empty, and the procedure quits and returns to step P2.

An alternative embodiment of the present invention is described below. According to the alternative embodiment, the user is able to optionally select either transparent or non-transparent toner when the recording medium is white paper. Furthermore, the amount of remaining transparent toner and non-transparent toner in the developers can be compared to automatically select the developer containing the most toner.

The alternative embodiment is comprised of a three-position toner selector switch S10 which is replaced by buttons 66, 67 and 68, shown in FIG. 4, on the operation panel for toner selection. When toner selector switch S10 is switched to a first position to select the transparent toner, switch S10 outputs a signal 1; when switch S10 is switched to a second position to select the non-transparent toner, switch S10 outputs a signal 2; and when switch S10 is switched to a third position to select neither of the transparent and non-transparent toner, switch S10 outputs a signal 0.

Figure 7:
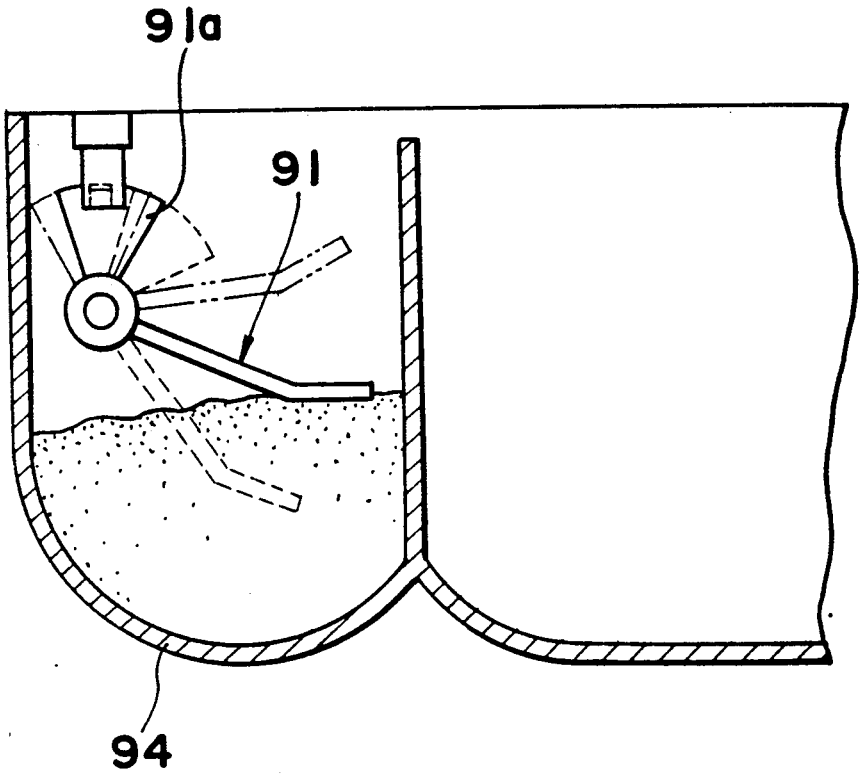
FIG. 7 is a cross-sectional view of a toner tank installed with a toner level detector for use in an alternative embodiment of the present invention.
Figure 8A:
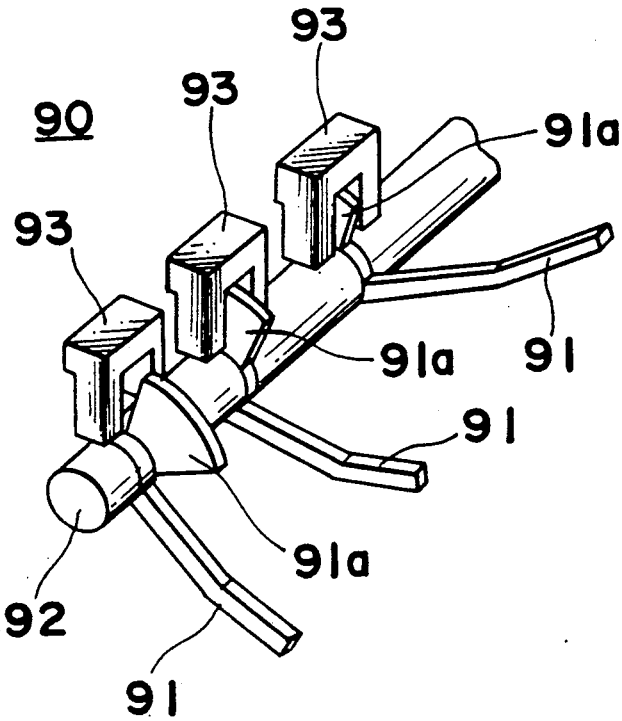
FIGS. 8*a* and 8*b* are perspective views of the toner level detector of FIG. 7.
Figure 8B:
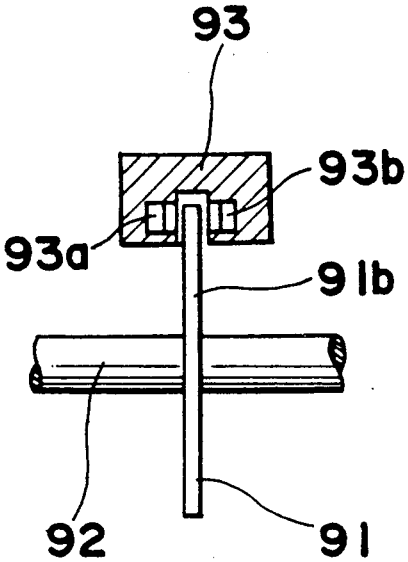

The alternative embodiment is also able to detect the amount of toner remaining in the developer by means of the toner level detector 90 shown in FIGS. 7, 8*a* and 8*b*. Specifically, the toner tank 94 has a lever 91 which turns about a shaft 92 located at the top of the tank. One end of the lever 91 floats on top of the toner, the other end of the lever is provided with an interrupter 91*a*, and intermediate thereof is rotatably mounted on shaft 92. The interrupter 91*a* moves freely between light emitter 93*a* and light receptor 93*b* of the photoelectric detector 93 in which the emitter and receptor are opposite each other. When the amount of toner in the toner tank 94 is more than a predetermined level, the interrupter 91*a* of the lever enters the photoelectric detector 93 and blocks the light from the light emitter 93*a*. When the toner level drops below another predetermined level, the interrupter 91*a* moves out from the photoelectric detector 93, and the detection signal becomes ON. Multiple photoelectric detectors 93 are provided so that the toner level can be detected in four different levels according to the ON signals from three photoelectric detectors 93.

A toner level detector 90 as described above is provided in each of the developers 5 and 6 loaded with transparent and non-transparent toner, respectively, thus making it possible to determine which developer 5 or 6 has the least amount of toner by comparing the output signals from the detectors in each developer.

Figure 9:
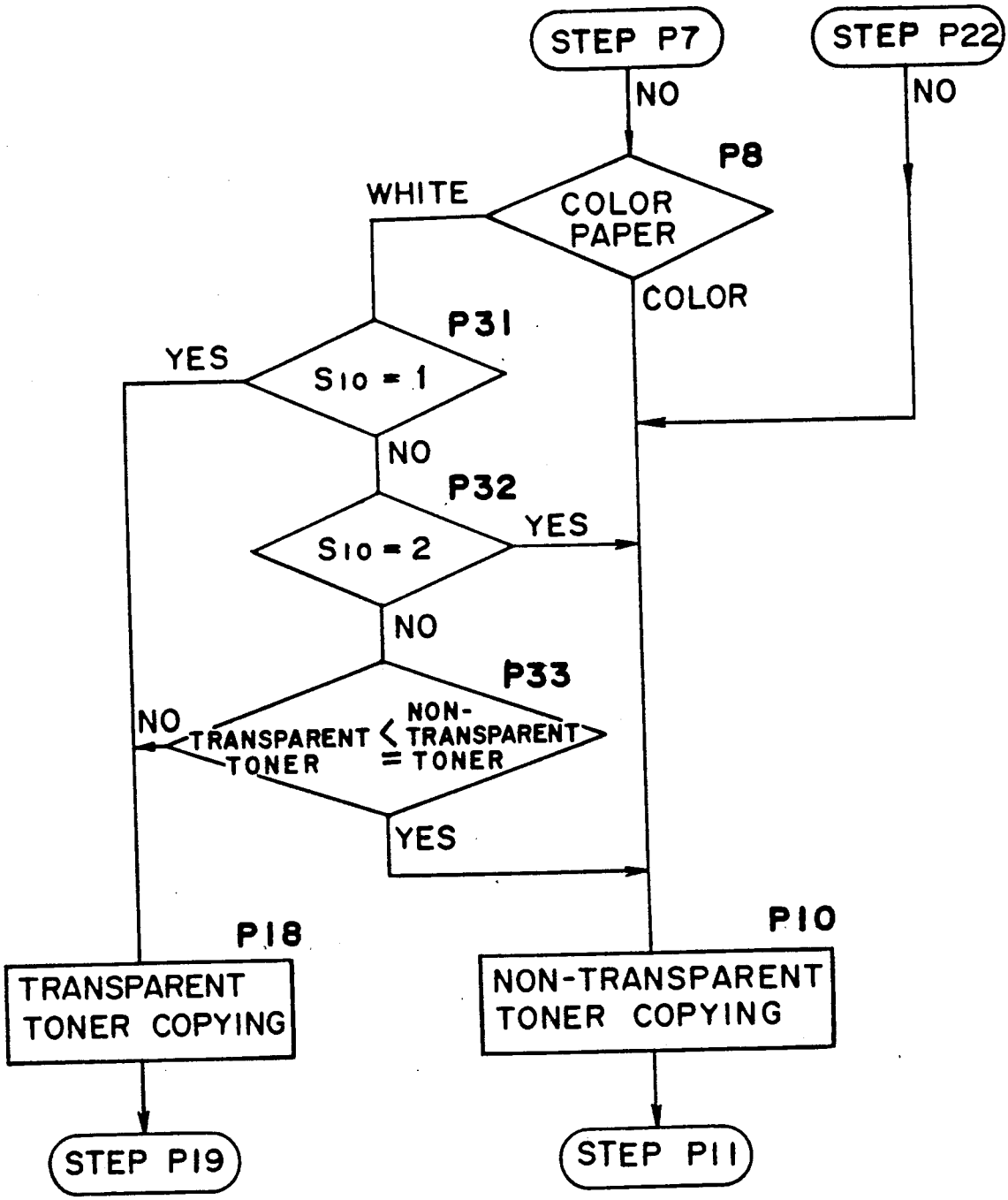
FIG. 9 is a flow chart showing an operation according to the alternative embodiment of the present invention.

Referring to FIG. 9, a flow chart is shown for the operation of the alternative embodiment according to the present invention. The steps P31, P32 and P33 replace the step P9 between step P8 and steps P10 and P18 in the flow chart shown in FIG. 6.

At step P8 it is detected whether the recording medium is color paper or not. If the recording medium is white paper, the procedure moves to step P31. At steps P31 and P32 the setting of toner selector switch S10 is read to detect whether the operator has selected transparent or non-transparent toner. If toner selector switch S10 is producing 1, indicating that transparent toner was selected, the procedure branches to step P18; if switch S10 is producing 2, indicating that non-transparent toner was selected, the procedure branches to step P10. If the switch S10 is producing neither 1 nor 2, it is indicated that the user has not made a toner selection. In this case, the toner levels in the toner tanks are determined so that the developer containing the most toner is selected. Then, the output signal from the toner level detector 90 as described above is read and if the non-transparent toner level is greater, the procedure advances to step P10; and if the transparent toner level is greater, the procedure advances to step P18 (step P33).

As described above, an imaging device according to the present invention detects the transmissivity of the recording medium, and if the transmissivity is not high, it determines whether the recording medium is white or a non-white color. If the transmissivity of the recording medium is high, operation is controlled so that a developer with transparent toner is used for imaging, and if the recording medium is a non-white color, operation is controlled s that a developer with non-transparent toner is used. It is thus possible to produce good copies which, when made on OHP film, can be projected with good reproduction of the image colors, and which, when made to color paper, can be made without the color of the toner being mixed with the color of the paper.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claim unless they depart therefrom.

What is claimed is:

1. An electrophotographic imaging device comprising: .

first developer for carrying transparent type toner;

second developer for carrying non-transparent type toner;

first supplying means for supplying first recording medium;

first recording medium detecting mean for detecting the type of recording medium loaded in said first supplying means from transparent recording medium and non-transparent recording medium; and control means for controlling the selection between said first and second developers such that said first developer is selected when said first recording medium detecting means detects that transparent recording medium is loaded in said first supplying means.

2. An electrophotographic imaging device as claimed in claim 1, wherein said first recording medium detecting means detects the type of recording medium loaded in said first supplying means from transparent recording medium, non-transparent white recording medium and non-transparent color recording medium.

3. An electrophotographic imaging device as claimed in claim 2, wherein said control means controls the selection between said first and second developers such that said second developer is selected when said first recording medium detecting means detects that non-transparent color recording medium is loaded in said first supplying means.

4. An electrophotographic imaging device as claimed in claim 3, wherein said control means controls the selection between said first and second developers such that, when said first recording medium detecting means detects that non-transparent white recording medium is loaded in said first supplying means, the same developer as that selected in the previous cycle is selected.

5. An electrophotographic imaging device as claimed in claim 3, further comprising a toner amount detecting means provided in each of said first and second developers.

6. An electrophotographic imaging device as claimed in claim 5, wherein said control means controls the selection between said first and second developers such that, when said first recording medium detecting means detects that non-transparent white recording medium is loaded in said first supplying means, a developer with more toner as detected by said toner amount detecting means is used.

7. An electrophotographic imaging device as claimed in claim 1, further comprising:

second supplying means for supplying second recording medium;

second recording medium detecting means for detecting the type of recording medium loaded in said second supplying means between transparent recording medium and non-transparent recording medium; and said control means for controlling the selection between said first and second developers such that said first developer is selected when said second recording medium detecting means detects that transparent recording medium is loaded in said second supplying means.

8. An electrophotographic imaging device comprising:

first developer for carrying transparent type toner, second developer for carrying non-transparent type toner, first supplying means for supplying first recording medium;

second supplying means for supplying second recording medium;

first recording medium detecting means for detecting the type of recording medium loaded in said first supplying means;

second recording medium detecting means for detecting the type of recording medium loaded in said second supplying means;

an activating means for activating one of said first and second supplying means; and control means for controlling the selection between said first and second developers such that said first developer is selected when the recording medium loaded in the activated supplying means is the transparent recording medium as detected by said recording medium detecting means.

9. An electrophotographic imaging device comprising:

a first developer for carrying transparent type toner;

a second developer for carrying non-transparent type toner;

supplying means for supplying a sheet of recording medium;

detecting means for detecting the type of the recording medium loaded in the supplying means whether or not the recording medium is a type of non-transparent white;

control means for controlling the selection between the first and second developers so as to select the same developer as that having selected in the previous cycle of selection when the detecting mean detects that non-transparent white recording medium is loaded in the supplying means.

10. An electrophotographic imaging device comprising:

a first developer for carrying transparent type toner, the first developer having a toner amount detector;

a second developer for carrying non-transparent type toner the second developer having a toner amount detector;

supplying means for supplying a sheet of recording medium;

detecting means for detecting the type of the recording medium loaded in the supplying means whether or not the recording medium is a type of non-transparent white;

control means for controlling the selection between the first and second developers so as to select one developer which carries larger amount of toner than another developer when the detecting means detects that non-transparent white recording medium is loaded in the supplying means.

* * * * *